US010945571B2

(12) United States Patent
Moran

(10) Patent No.: US 10,945,571 B2
(45) Date of Patent: Mar. 16, 2021

(54) SELF-CLEANING CARPET

(71) Applicant: Robert J. Moran, Belmont, MA (US)

(72) Inventor: Robert J. Moran, Belmont, MA (US)

( * ) Notice: Subject to any disclaimer, the term of this patent is extended or adjusted under 35 U.S.C. 154(b) by 228 days.

(21) Appl. No.: 16/010,203

(22) Filed: Jun. 15, 2018

(65) Prior Publication Data

US 2018/0360280 A1 Dec. 20, 2018

Related U.S. Application Data

(60) Provisional application No. 62/520,377, filed on Jun. 15, 2017.

(51) Int. Cl.

| | |
|---|---|
| ***A47L 7/00*** | (2006.01) |
| ***A47L 9/24*** | (2006.01) |
| ***A47L 11/34*** | (2006.01) |
| ***A47G 27/02*** | (2006.01) |
| ***D06G 1/00*** | (2006.01) |

(52) U.S. Cl.

CPC ..... *A47L 7/0004* (2013.01); *A47G 27/02* (2013.01); *A47G 27/0287* (2013.01); *A47G 27/0293* (2013.01); *A47L 7/0047* (2013.01); *A47L 9/248* (2013.01); *A47L 11/34* (2013.01); *D06G 1/00* (2013.01); *A47L 2601/02* (2013.01)

(58) Field of Classification Search

CPC ..... E04F 11/00; A47L 11/4011; A47L 11/00; A47L 11/4044; A47L 11/4088; A47L 7/0004; A47L 11/34; A47L 9/2826; A47L 11/4002; A47L 7/0047; A47L 9/248; A47L 2601/02; D06G 1/00; A47C 1/00; A47G 27/0293; A47G 27/0287; A47G 27/02

See application file for complete search history.

(56) References Cited

U.S. PATENT DOCUMENTS

| | | | | | |
|---|---|---|---|---|---|
| 3,064,298 | A * | 11/1962 | Jones | A47L 23/263 | 15/310 |
| 3,216,043 | A * | 11/1965 | Lipson | A47L 13/502 | 15/310 |
| 3,649,994 | A | 3/1972 | Harris | | |
| 3,786,531 | A | 1/1974 | Borg | | |
| 4,951,345 | A * | 8/1990 | Nappi, Sr. | A47L 23/263 | 15/302 |

(Continued)

OTHER PUBLICATIONS

International Preliminary Report on Patentability received for PCT/US2018/037889, dated Dec. 26, 2019, 6 pgs.

(Continued)

*Primary Examiner* — Benjamin L Osterhout

(74) *Attorney, Agent, or Firm* — Glen E. Schumann; Moss & Barnett

(57) ABSTRACT

The present invention is a fiber self-cleaning system. The fiber self-cleaning system of the present invention includes interlocking mats containing bores for receiving cleaning tubes, cleaning tubes for mounting with the mat bores having an open top, beveled interior chamber and at least one transverse side opening, fiber groups mounted within the beveled interior chamber of the cleaning tubes, a water and vacuum line operatively connected to the cleaning tubes to introduce water, chemicals and air to the fiber groups or to apply a vacuum force to the fiber groups, and a pump operatively connected to the cleaning tubes to introduce or suction out water, chemicals and dirt from the fiber groups.

14 Claims, 5 Drawing Sheets

(56) References Cited

U.S. PATENT DOCUMENTS

| | | | | | |
|---|---|---|---|---|---|
| 5,870,797 | A | | 2/1999 | Anderson | |
| 5,991,967 | A | * | 11/1999 | Williams | A47L 23/263 15/311 |
| 6,105,201 | A | * | 8/2000 | Min | A47L 23/263 15/302 |
| 6,532,618 | B2 | * | 3/2003 | Koch | A47L 23/263 15/308 |
| 8,973,197 | B2 | * | 3/2015 | Omidi | A47L 23/263 15/36 |
| 9,179,820 | B2 | * | 11/2015 | Mufson | A47L 23/02 |
| 2008/0104782 | A1 | | 5/2008 | Hughes | |
| 2012/0167338 | A1 | | 7/2012 | Williams | |
| 2014/0265092 | A1 | | 9/2014 | Looney | |
| 2016/0015244 | A1 | | 1/2016 | Kang | |

OTHER PUBLICATIONS

International Search Report and Written Opinion received for PCT/US2018/037889, dated Aug. 30, 2018, 8 pgs.

* cited by examiner

SELF-CLEANING CARPET

CROSS REFERENCE TO RELATED APPLICATION

This application claims priority to Provisional Application No. 62/520,377, filed on Jun. 15, 2017, the contents of which are incorporated herein by reference.

FIELD OF THE INVENTION

The present invention is related to a fiber self-cleaning system for cleaning fibers of a type that may be used in carpets, upholstery, artificial turf or other applications where the fibers may be exposed to dirt or other contaminants and need to be cleaned. For exemplary purposes only, the invention will be described primarily in terms of a carpet application with occasional notes about other applications of the system.

BACKGROUND OF THE INVENTION

Many systems and products have been developed for cleaning carpets. For instance, detergents and water may be directly applied by hand or spray canister to carpets. The detergent and/or water are then removed from the carpet by known means, such as absorbent cloths. Hand vacuum scrubbers apply water and detergent directly to the carpet and then vacuum up the detergent, dirt and water for disposal. More sophisticated systems powered by vacuums mounted to vehicles are also used to apply water/steam/detergent and other chemicals to a carpet and then vacuum up the water/steam/detergent and other chemicals and dirt from the carpet for disposal. However, all of these systems require significant manual labor and devices to clean the carpet. There remains a need for a carpet fiber cleaning system that can be automated and require virtually no manual labor or other devices to clean the carpet fibers.

SUMMARY OF THE INVENTION

The present invention is a fiber self-cleaning system for cleaning fibers of a type that may be used in carpets, upholstery, artificial turf or other applications where the fibers may be exposed to dirt or other contaminants and need to be cleaned. For simplicity, the invention is described for fibers utilized in carpeting, but the same system could readily be applied to other fiber applications.

The fiber self-cleaning system of the present invention includes, as applied to carpets includes interlocking mats containing bores for receiving cleaning tubes, cleaning tubes for mounting with the mat bores having an open top, beveled interior chamber and at least one transverse side opening, fiber groups mounted within the beveled interior chamber of the cleaning tubes, a water and vacuum line operatively connected to the cleaning tubes to introduce water, chemicals and air to the fiber groups or to apply a vacuum force to the fiber groups, and a pump operatively connected to the cleaning tubes to introduce or suction out water, chemicals and dirt from the fiber groups.

DETAILED DESCRIPTION OF THE INVENTION

For a thorough understanding of the present disclosure, refer to the following detailed description, including the appended claims, in connection with the above-described drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The carpet mats 1 of the present invention come, in one embodiment, in square or rectangular carpet mats (see 1 in FIG. 1) that can easily be interlocked in side-by-side relation by means known in the art. These carpet mats may be of varying dimensions, such as 3×4 feet, 4×4 feet, or 2×2 feet. (Other dimensions and configurations, including irregular pieces of mats, can be utilized as well.) These carpet mats are designed to interlock with adjoining mats on any and all sides of the mat.

The mats may be hollow or solid and may be constructed of any durable material that is resistant to chemical, such as rubber, "spongy" or "springy" foam, hard plastic, or sheet metal or other material covered by a chemical or corrosion resistant protective coating, such as rubberized foam. The mats are placed on a floor or steps (or in an alternate use, furniture or other objects) in side-by-side interlocking relation until the desired area of the floor or surface area is covered.

Figure 1A:
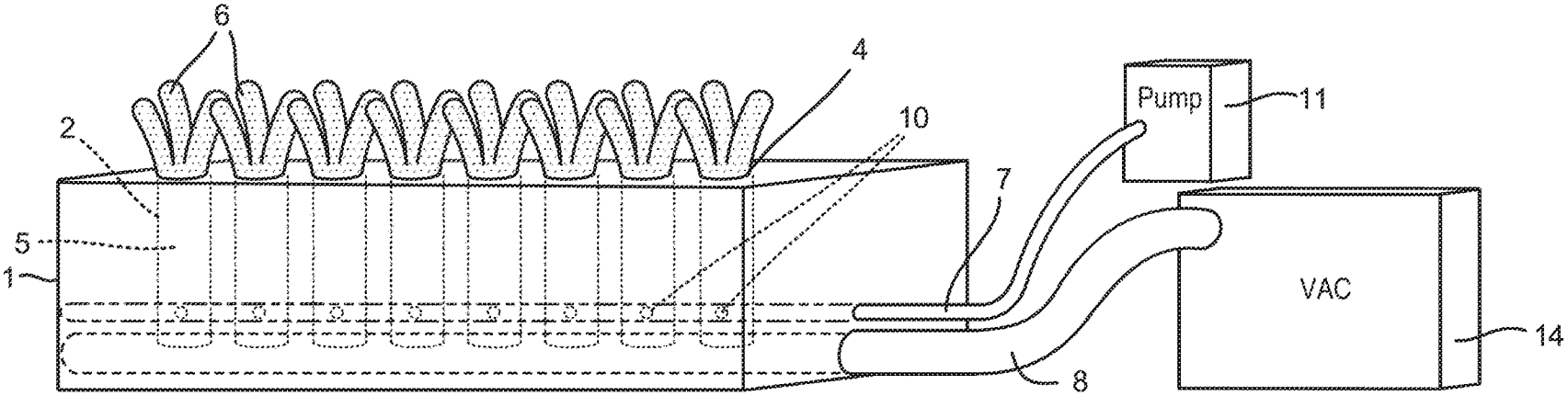
FIG. 1A is perspective view of a carpet mat of the present invention, including a water pump and air and water vacuum.
Figure 1C:
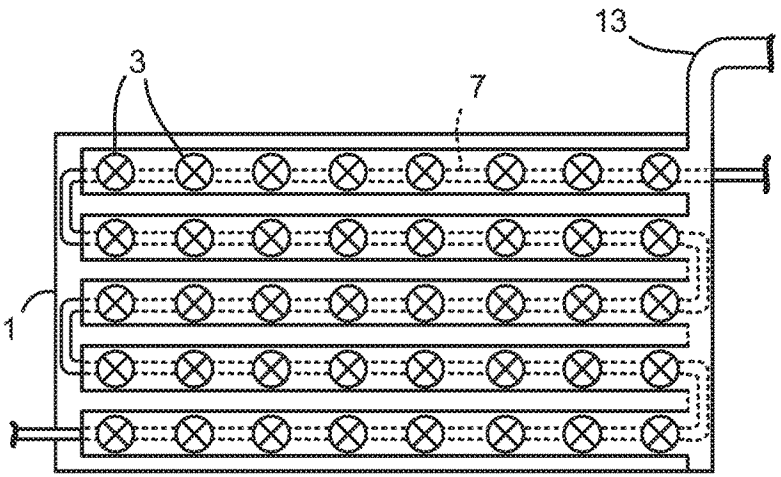
FIG. 1C is the bottom view of a carpet mat of the present invention illustrating the orientation and arrangement of cleaning tubes, a waterline and a vacuum line.
Figure 1B:
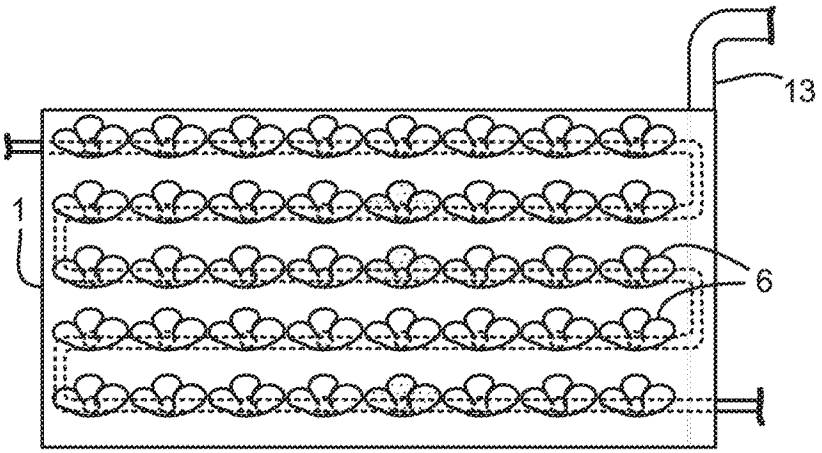
FIG. 1B is a top view of a carpet mat of the present invention.

As illustrated in FIG. 1, carpet mat 1 includes, in one embodiment, a series of cylindrical bores 2 (other configurations are possible) (or openings, if a hollow mat is utilized). These bores are vertically oriented when the mat is placed horizontally on a floor or other surface and are open at the top of the mat. The bores are designed to receive cleaning tubes 3.

Figure 2A:
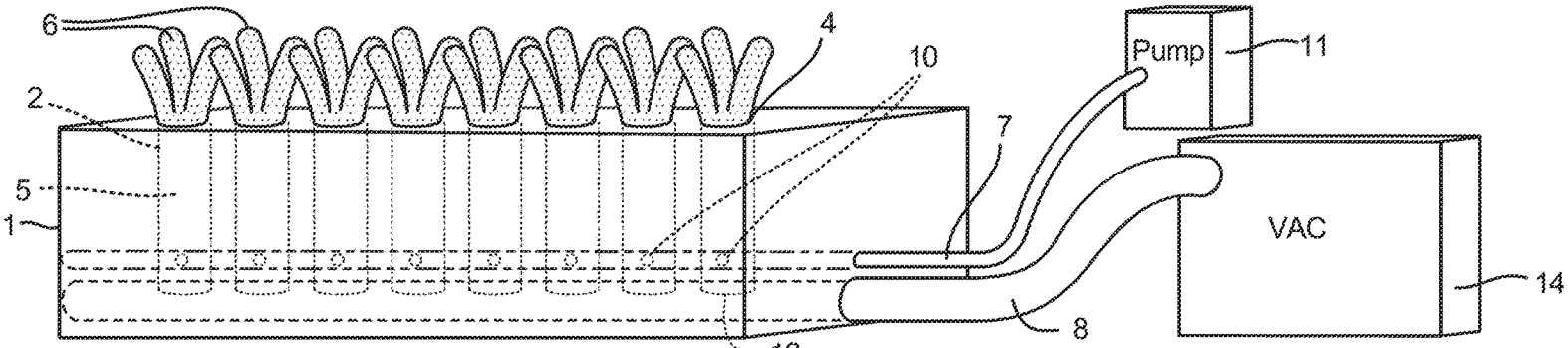
FIG. 2A is a perspective view of a carpet mat of the present invention illustrating the mounting of the carpet fibers within the cleaning tubes and fiber groups.
Figure 2B:
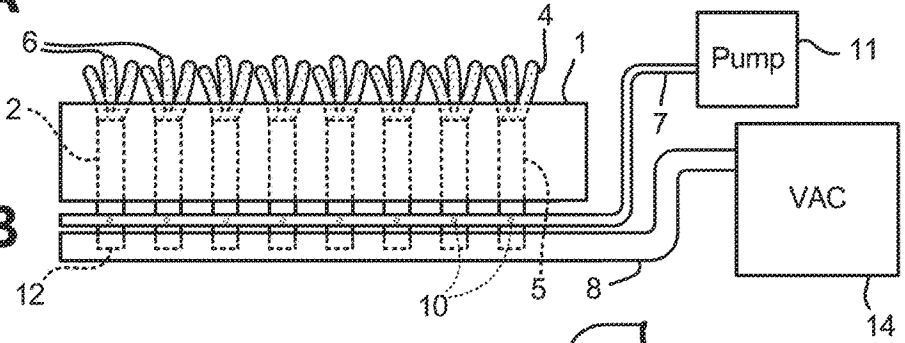
FIG. 2B is a side view of a carpet mat of the present invention illustrating the mounting of the carpet fibers within the cleaning tubes.

The cleaning tubes 3 have an open top 4 and define an internal chamber 5 within which a carpet fiber group 6 is nested (FIGS. 1A, 2A and 2B). In one preferred embodiment, the cleaning tube chamber is beveled (FIG. 3) as discussed below.

The cleaning tubes also include a pair of oppositely placed side orifices, transversely aligned to a longitudinal axis of the tube, for receiving a water line 7. (In an alternative embodiment, the cleaning tubes may have only one side orifice with a water line in fluid communication with the cleaning tube chamber through the one opening.)

Figure 3A:
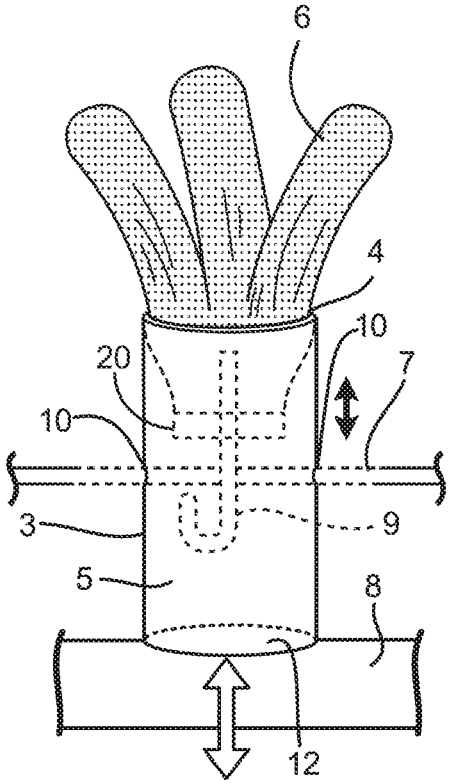
FIG. 3A is a side view of the cleaning tube illustrating its attachment to the vacuum line and waterline and the mounting of the fiber group within the cleaning tube.
Figure 3B:
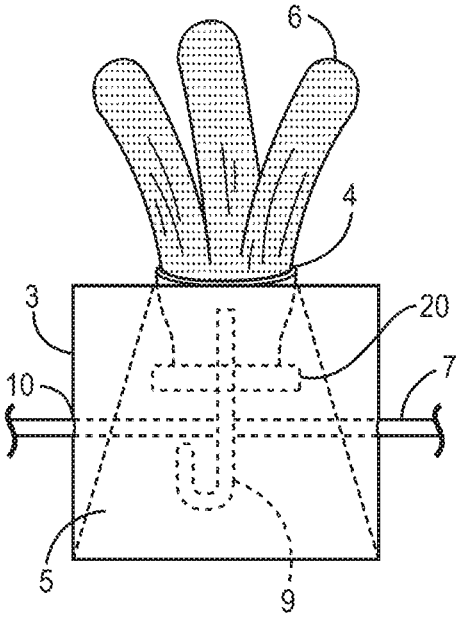
FIG. 3B is a sectional view of a cleaning tube with the fiber group in a lowered or nested position with a beveled version of the cleaning tube chamber.
Figure 3C:
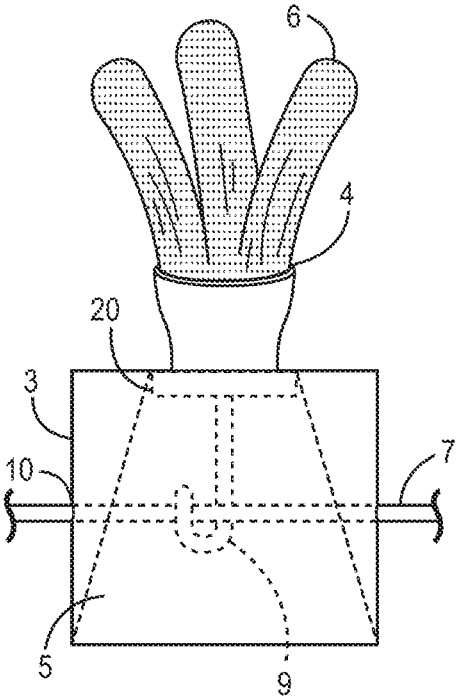
FIG. 3C is a sectional view of a cleaning tube with the fiber group in a raised or cleaning position with a beveled version of the cleaning tube chamber.

In the embodiment where the cleaning tubes have two aligned side orifices, water line 7 is threaded through the cleaning tube transverse orifices as shown in FIGS. 1C and 3. Water line 7 is typically tubular and includes side wall openings 10 positioned within a corresponding cleaning tube chamber to direct fluid (water and/or chemical) into the cleaning tube chamber. In one preferred embodiment, the water line is sized to form a seal with the transversely aligned orifices through which the line passes to prevent water from escaping the cleaning tube through the orifices. Other known mechanisms for sealing the water line and tube orifices to prevent fluid escaping from the cleaning tube chamber through the transverse orifices are also anticipated by the present invention.

Water line 7 may be composed of any suitable, chemical and corrosion resistant material, but in one embodiment, is composed of flexible rubber or silicon.

Carpet fiber group 6 is designed to move up and down in the cleaning tube chamber but is normally nested in a down position with the fibers extending above the opening of the cleaning tube and the bottom of the fiber group near the bottom of the cleaning tube chamber. The carpet fiber group 6 may include one carpet fiber, a bundle of carpet fibers or a grouping of fiber bundles.

In one embodiment, the carpet fibers are secured at a first end to a base 20 mounted inextricably within the cleaning tube chamber. For mounting purposes, the base may collapse when inserted into the cleaning tube chamber, but expand to prevent removal from the chamber. Alternatively, the fiber group may be prevented from being removed from the cleaning tube due to size and/or configuration of the base compared to the size and configuration of the top of the cleaning tube, or an O-ring may be secured to the first end of the fiber group within the cleaning tube (not illustrated) to prevent removal of the fiber group, or the fiber group may be prevented from being removed from the cleaning tube chamber by other means known in the art. The purpose of this arrangement is to prevent the fiber group from being forced out of the cleaning tube chamber by the pressure of water and chemical introduced into the cleaning tube chamber.

In another preferred embodiment illustrated in this application, one end of the fibers are secured to a hook 9 which is designed to engage and disengage the waterline running through the cleaning tube as the carpet fiber group moves up and down, respectively, in the cleaning tube chamber due to introduction of water and chemical into or application of a vacuum force on the cleaning tube chamber. The hook prevents the fiber tube from being forced out of the tube chamber. (In another embodiment, the hook 9 may be designed to engage a ridge at the cleaning tube opening 4.) Other known methods for securing one end of the fibers within the tube so that the fibers may be partially retracted into or extended out of the cleaning tubes, but preventing from being completely withdrawn from the tubes, are also anticipated by the present invention.

The hook can be rigid or flexible, made of metal or plastic or metal coated with galvanized metal or other chemical or chemical or corrosive resistant material, although other materials designed to provide the right strength, rigidity or flexibility or resist corrosion due to water and chemical, are anticipated by the present invention.

The ends of the water line 7 are connected to a water pump 11 which in turn is connected to a water source (not shown). The water line is used to force water and/or chemical through the water line openings into the cleaning tube chambers. (Chemicals include detergents, deodorizers, anti-mold agents and other liquid product that can be added to the water.

More than one waterline may be utilized in the system, depending on the number of cleaning tubes, but typically, only one water line runs through each cleaning tube. These water lines can be connected back to the water source to provide a more even distribution of water throughout the interlocked mats.

Figure 4:
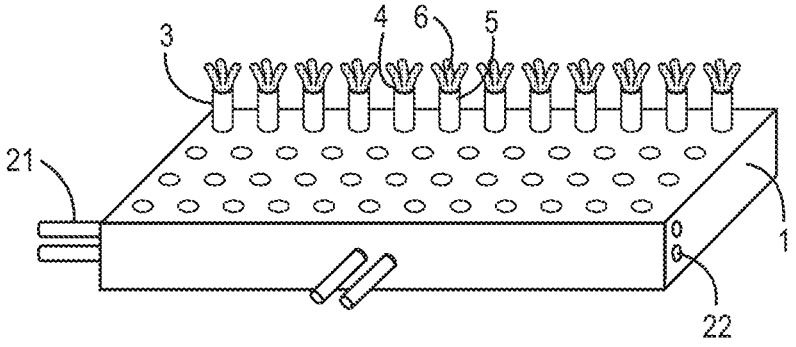
FIG. 4 is a perspective view of an alternate version of a mat, hollow inside, for indirect application of a vacuum force to the cleaning tube chambers.
Figure 5:
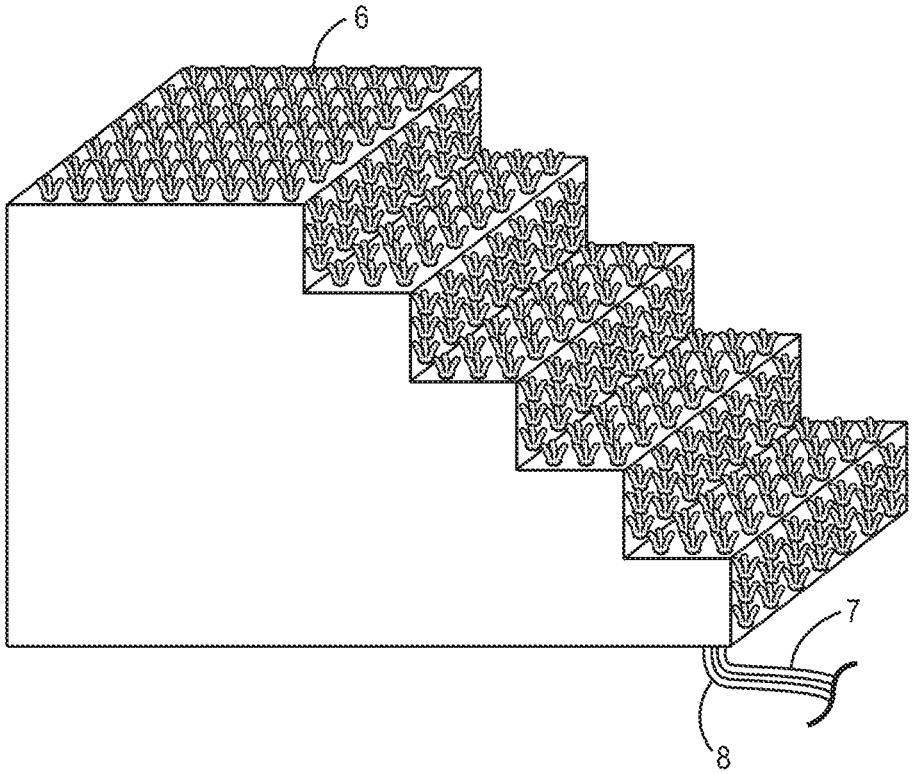
FIG. 5 is a perspective view of steps on a stairway illustrating application of the fiber cleaning invention.
Figure 6:
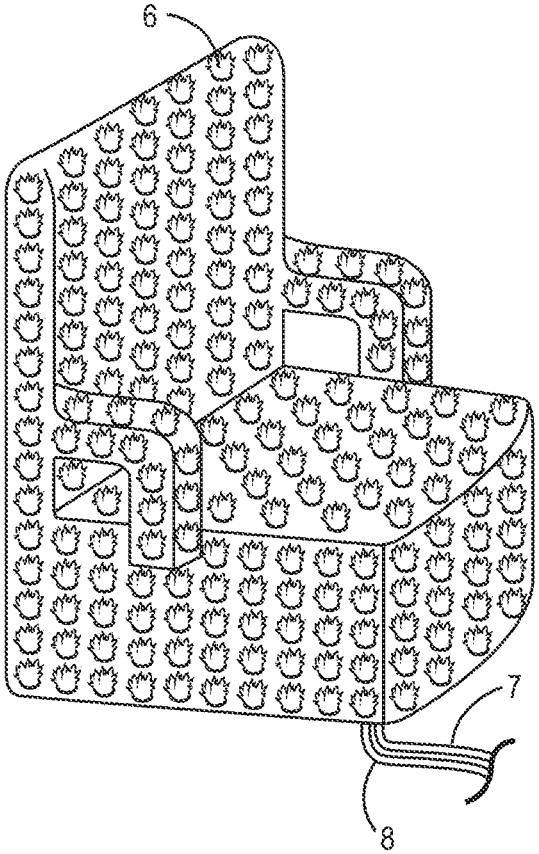
FIG. 6 is a perspective view of an upholstered chair illustrating application of the fiber cleaning invention to furniture.

The cleaning tubes also include an opening 12 for fluid communication between the cleaning tube chamber and a vacuum or vacuum line. In one embodiment, a vacuum force may be applied to the cleaning tube chamber through a connected vacuum line 8 (FIG. 1A). If a hollow mat is utilized, a vacuum force may be applied to the interior of the hollow mat that then indirectly applies a vacuum force on the cleaning tube chambers, as shown in FIG. 4. Two preferred embodiments are a vacuum in fluid communication with the hollow interior of a hollow mat to apply a vacuum force on the cleaning tube chambers, as shown in FIG. 4, or a vacuum line running from the vacuum directly to the cleaning tube chambers, as shown in FIG. 1A.

The vacuum draws water, chemical and dirt out of the cleaning tubes. More than one vacuum line may be utilized depending on the number of cleaning tubes. In one embodiment, one vacuum line attaches to a group of cleaning tubes, but there is typically no need to connect any particular cleaning tube or group of cleaning tubes to more than one vacuum line. (In the embodiment where vacuum force is applied to the hollow interior of the mat, there are no vacuum lines connected to the cleaning tubes.)

In one preferred embodiment, the vacuum and water lines are secured to the bottom of the mat and each mat is sealed on the bottom to prevent leakage. The water and vacuum lines mounted on each mat include connectors at each end for connection to corresponding water and vacuum lines on other interlocked mats. The means for interlocking the water lines and vacuum lines of adjoining mats include a threaded connector, quick connector or any other method for connecting pipes or lines known in the art (including but not limited to: connectors for water lines, electrical lines, gas lines, etc.). The vacuum connections can be connected directly to the vacuum as well. This allows for more even suction across the entire breadth of the carpeted area.

In another preferred embodiment, vacuum "lines" are defined by bores running through a foam or solid mat (no parallel tubes), which function in the same manner as actual vacuum lines.

Referring to FIG. 4, a hollow mat may include both vacuum and water line or channel male connectors 21 on two sides of the mat and two female connectors 22 on the other two sides of the rectangular mat, so that mating mats can be interlocked to create continuous water and vacuum "lines" or connections throughout the mat system. Once the desired floor or surface area is covered by the mats, in order to create the desired vacuum force and prevent water and chemical spillage, open water and vacuum connectors may be capped or sealed by known means.

Figure 2C:
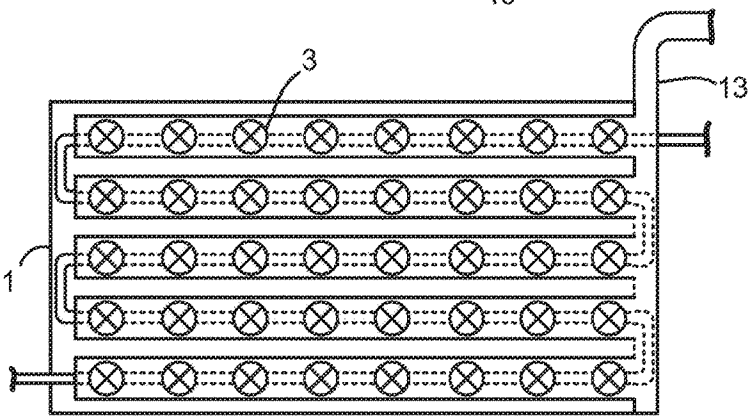
FIG. 2C is a bottom view of a carpet mat of the present invention illustrating the mounting of the cleaning tubes and the generally parallel alignment of the water and vacuum lines throughout the foam mat.

In one embodiment, as shown in FIG. 2C, multiple vacuum lines are mounted below or along a bottom edge of the mat. The vacuum lines are in spaced parallel alignment extending along the length of the mat. A transverse vacuum line 13 is mounted below or along a bottom edge of the mat, transverse to the parallel vacuum lines, in fluid communication with a first end of each of the parallel vacuum lines. The transverse vacuum line is in turn connected to a vacuum 14 which in turn is connected to a water disposal system (not shown). The water disposal system can be any known system in the art, such as a drain, a drain hose leading to a drain, a filtered recycling unit, a container, etc.

The vacuum system can be utilized as a blower to force air through the carpet fibers to dry the same. After the carpet fibers are cleaned, the vacuum is reversed, blowing drying air on the fibers to blow off moisture. Alternatively, a vacuum force can be applied to the carpet fibers until dry.

A control system (not shown) controls operation of the pumps, allowing for adjustment of time and extent of use of the system, water pressures, additives and other features of the invention.

In operation, water and/or chemical is pumped through the water line, water line orifices 4, into the cleaning tube chambers on command from the control system. Water and chemical engage the carpet fiber groups and force the carpet fiber groups to move upward in the cleaning tubes and the carpet fibers are washed with the water and chemical. The hooks on the carpet fiber groups engage the water line, preventing the fiber groups from being pushed out of the cleaning tube. A vacuum is then applied, drawing the carpet fiber group back into the cleaning tube and drawing the water, chemical and dirt back to the vacuum disposal system. This "wash" and "rinse" action of the water line and vacuum draw water, chemical and dirt out of the carpet fiber groups. This process may be repeated, alternating between introducing water and chemical, or just water, and vacuuming out the water, chemical and dirt, until the carpet fibers are cleaned. The vacuum pump is then reversed to blow air through the carpet fiber groups to help dry the fibers.

In another preferred embodiment, the carpet fiber groups do not move up and down in the cleaning tube chambers, but are held in place, but water and chemical nevertheless wash over the carpet fibers and the vacuum can be used to draw out the water, chemical and contaminants or dirt to clean the carpet fibers.

In one preferred embodiment, a moisture sensor is added to the system at various locations on the carpet mats to detect spilled liquids (such as spilled drinks or animal urine) or identifying flooding of the carpet, triggering automatic operation of the system to remove the undesired liquid. The sensor can be a hard wired mat-to-interlocked mat to controller, or a wireless system including sensors strategically placed, read by a signal receiving unit operatively connected to the control system to turn on the vacuum. In areas where flooding occurs from time to time, this system is particularly advantageous to address flooding conditions as early as possible.

In one preferred embodiment, light emitting diodes can be added to the carpet mats in the same fashion as the moisture sensing system to identify spills, areas that have or have not been cleaned or to provide other desired information to the control system.

In another preferred embodiment, the water and detergent may be introduced through a single orifice in the cleaning tube and the vacuum and blower force may be applied through a line or channel in fluid communication with the cleaning tube at the cleaning tube orifice.

Other improvements of the fiber self-cleaning system include an allergy free environment and elimination of dust mites, among other things.

The invention claimed is:

1. A fiber self-cleaning system including the following:

i. a mat defining one or more bores for receiving one or more corresponding cleaning tubes;

ii. at least one cleaning tube having an open top and defining an interior chamber, and further including at least one cleaning tube fluid orifice for introducing water, chemical or air into the interior chamber of the cleaning tube or a vacuum force on the interior chamber of the cleaning tube;

iii. at least one carpet fiber group mounted within a corresponding cleaning tube;

iv. at least one a fluid channel in fluid communication with the cleaning tube fluid orifice;

v. a pump capable of applying a positive or negative force in fluid communication with one or more of a water, chemical or air source and the fluid channel; and vi. a control system for instructing the pump to introduce one or more of water, chemical or air through the at least one fluid channel and its corresponding cleaning tube fluid orifice into the interior chamber of at least one cleaning tube or to apply a vacuum force through the at least one fluid channel and a corresponding cleaning tube fluid orifice to the interior chamber of at least one cleaning tube.

2. The fiber self-cleaning system of claim 1 wherein the mat is hollow defining the fluid channel.

3. The fiber self-cleaning system of claim 1 wherein the at least one fluid channel is a tube connected at a first end to a cleaning tube fluid orifice of the cleaning tube and at a second end to the pump.

4. The fiber self-cleaning system of claim 1 wherein the cleaning tube includes first and second orifices, the fluid channel is a tube connected at a first end to the first cleaning tube fluid orifice of the cleaning tube and at a second end to the pump for applying a vacuum force on the cleaning tube interior chamber and further including a second cleaning tube connected at a first end to the second cleaning tube fluid orifice of the cleaning tube and at a second end to the pump for delivery of one or more of water, chemical or air into the cleaning tube interior chamber.

5. The fiber self-cleaning system of claim 1 wherein the cleaning tube includes first, second and third orifices, the second and third orifices being oppositely aligned on the cleaning tube, the fluid channel is a tube connected at a first end to the first cleaning tube fluid orifice of the cleaning tube and at a second end to the pump for applying a vacuum force on the cleaning tube interior chamber, and further including a second tube having a side wall opening, the second tube being threaded through the second and third orifices so that the side wall opening is positioned within the cleaning tube interior chamber, the second tube being connected at a second end to the pump for delivery of one or more of water, chemical or air into the cleaning tube interior chamber.

6. The fiber self-cleaning system of claim 5 wherein at least one carpet fiber group mounted within a corresponding cleaning tube is movable between a retracted position within the cleaning tube interior chamber and an extended position at or above the open top of the cleaning tube in response to a positive or negative force applied to the interior chamber of the cleaning tube, the carpet fiber group further including a hook secured to the base of the carpet fiber group, such that the hook engages the second tube when the carpet fiber group is in the extended position to prevent the carpet fiber group from being forced out of the cleaning tube.

7. The fiber self-cleaning system of claim 6 wherein the mat and hook are coated with a chemically resistant material.

8. The fiber self-cleaning system of claim 1 further including a moisture sensor in communication with the control system and mounted on or near the mat for detecting liquid on the mat, causing a signal to be sent to the control system to trigger a vacuum action by the pump to remove the undesired liquid.

9. The fiber self-cleaning system of claim 1 further including sensors and lights in communication with the control system and mounted on or near the mat for detecting one or more fibers cleaned, fibers to be cleaned, damp fibers, dry fibers, liquid on the mat or other programmable situations.

10. The fiber self-cleaning system of claim 1 wherein the cleaning tube has a beveled interior chamber, narrower at the open top of the cleaning tube, and the carpet fiber group includes a base of size or configuration that the narrower top opening of the cleaning tube prevents the carpet fiber group from being removed from the cleaning tube.

11. The fiber self-cleaning system of claim 1 including two or more interlocking mats, including means for interconnecting the fluid channels of each mat.

12. The fiber self-cleaning system of claim 1 including two or more interlocking mats, including means for interlocking the mats and means for interconnecting the fluid channels of each mat.

13. The fiber self-cleaning system of claim 1 wherein the mat has a generally rectangular or square configuration.

14. The fiber self-cleaning system of claim 1 wherein the carpet fiber group includes fibers having a top end and bottom end secured to a base, and wherein the carpet fiber group moves up and down the cleaning tube interior chamber between an extended position with the fibers substantially positioned above the top open end of the cleaning tube and a retracted position with the fibers positioned partially below the top open end of the cleaning tube.

* * * * *